US010734175B1

(12) United States Patent
Rostron et al.

(10) Patent No.: US 10,734,175 B1
(45) Date of Patent: Aug. 4, 2020

(54) HIGH VOLTAGE ELECTRIC POWER SWITCH WITH ANTI-FLASHOVER NOZZLE

(71) Applicant: Southern States, LLC, Hampton, GA (US)

(72) Inventors: Joseph R Rostron, Hampton, GA (US); Zack Beecher, Hampton, GA (US); Ryun Kim, Hampton, GA (US)

(73) Assignee: Southern States LLC, Hampton, GA (US)

( * ) Notice: Subject to any disclaimer, the term of this patent is extended or adjusted under 35 U.S.C. 154(b) by 0 days.

(21) Appl. No.: 16/580,568

(22) Filed: Sep. 24, 2019

(51) Int. Cl.
*H01H 33/24* (2006.01)
*H01H 33/64* (2006.01)

(52) U.S. Cl.
CPC ..... *H01H 33/24* (2013.01); *H01H 33/64* (2013.01)

(58) Field of Classification Search
CPC ..... H01H 33/24; H01H 33/60; H01H 33/64; H01H 33/7023; H01H 33/7038; H01H 33/74; H01H 2033/902; H01H 33/04; H01H 33/56; H01H 33/70
USPC ..... 218/49, 48, 53, 57, 62, 63, 72
See application file for complete search history.

(56) References Cited

U.S. PATENT DOCUMENTS 4,291,208 A * 9/1981 Cromer ..... H01H 33/7023 218/62
4,829,150 A * 5/1989 Sasamori ..... H01H 33/7069 218/62
5,388,451 A * 2/1995 Stendin ..... H02B 13/065 218/43
5,453,591 A * 9/1995 Stroud ..... H01H 1/0015 218/43
5,488,199 A * 1/1996 Seising ..... H02G 15/068 174/140 R
6,744,000 B1 * 6/2004 Bergmann ..... H01H 33/24 218/43
6,744,001 B2 * 6/2004 Dufournet ..... H01H 33/901 218/53
7,078,643 B2 * 7/2006 Rostron ..... H01H 33/166 218/144
8,063,333 B2 11/2011 Rostron et al.
9,035,211 B2 * 5/2015 Schiffbauer ..... H01H 33/91 218/43
9,543,095 B2 * 1/2017 Kaneko ..... H01H 33/70

* cited by examiner

*Primary Examiner* — William A Bolton
(74) *Attorney, Agent, or Firm* — Mehrman Law Office; Michael J. Mehrman

(57) ABSTRACT

A high voltage electric power switch with an anti-flashover nozzle that suppresses the likelihood of a flashover occurring between switch components other than the switch contactors, such as the nozzle casing around the first contactor (e.g., female or socket) and the casing around the second contactor (e.g., male or pin) during an opening stroke of the contactors. The anti-flashover features include a corona ring positioned at the proximal end of the nozzle casing and a nozzle clamp ring positioned to the distal side of a nozzle casing abutment that mates with a nozzle receiver. The conventional nozzle includes a nib-shaped proximal end of the nozzle casing carrying a clamp ring positioned on the proximal side of the abutment. The new nozzle design reduces the high level of electric field stress created by the conventional nozzle casing to suppress the likelihood of a flashover occurring between the contactor casings.

15 Claims, 8 Drawing Sheets

HIGH VOLTAGE ELECTRIC POWER SWITCH WITH ANTI-FLASHOVER NOZZLE

TECHNICAL FIELD

The present invention relates to the field of high voltage electric power transmission and distribution systems and, more particularly, to a high voltage electric power switch with an anti-flashover nozzle.

BACKGROUND OF THE INVENTION

Circuit breakers, line switches, disconnect switches and capacitor switches are well known components of electric transmission and distribution systems. Within these devices, spring-driven acceleration mechanisms have been used to accelerate penetrating contactors to sufficient velocity to extinguish an arcing contact occurring across a contactor gap within the switch without experiencing an undesirable restrike, which could otherwise cause disturbances on the electric power system. This typically requires extinguishing the arc after one-half cycle, which prevents a restrike from occurring after the initial arc break that occurs at the first half-cycle zero voltage crossing after initial separation of the contacts. For this type of device, it is helpful to house the penetrating contactor within an insulator that forms a sealed container filled with a dielectric gas such as sulfur hexafluoride ($SF_6$), which is directed into the contactor gap by a nozzle to help extinguish the arc. Extinguishing the arc in this manner, which is specifically designed to effectively absorb the arc energy, reduces the contactor gap separation required to extinguish the arc from what would be required to extinguish the arc in another environment such as air. The basic design challenge for this type of device involves engineering an acceleration mechanism that obtains the desired contractor velocity quickly enough to extinguish the arc without experiencing an undesired restrike within acceptable weight, size and cost constraints. An example of this type of device are described in U.S. Pat. No. 8,063,333, which is incorporated herein by reference.

A great deal of attention has been paid to the design of the contactors and the nozzle of this type of switch to prevent potentially damaging restrikes from occurring between the contactors, which allows the contactors to withstand extremely high electric fields. A potential drawback can occur when the electric field between the contactors becomes so high that a flashover occurs between other components of the switch. For example, damaging flashovers have been known occur between the casings housing the contactors even though the casings are physically further apart than the contactors themselves.

Accordingly, there is an ongoing need for cost high voltage effective electric power switch design that avoid flashovers from occurring between internal switch components other than the penetrating contactors.

SUMMARY OF THE INVENTION

The present invention meets the needs described above through a high voltage electric power switch with an improved contactor including an anti-flashover nozzle design that suppresses the likelihood of a flashover occurring between switch components other than the switch contactors, such as the casing around the first contactor (e.g., female or socket) and the casing around the second contactor (e.g., male or pin) during an opening stroke of the contactors. The innovative anti-flashover features include a corona ring positioned at the proximal end of the nozzle casing and a nozzle clamp ring positioned to the distal side of an abutment between the nozzle casing and a nozzle receiver. The improved contactor design reduces the high level of electric field stress created by the conventional nozzle casing, which suppresses the likelihood of a flashover occurring between the nozzle casing and other components of the contactor, such as the pin (male) contactor casing.

The specific techniques and structures for implementing particular embodiments of the invention, and thereby accomplishing the advantages described above, will become apparent from the following detailed description of the embodiments and the appended drawings and claims.

DETAILED DESCRIPTION OF ILLUSTRATIVE EMBODIMENTS

The present invention may be embodied in a high voltage electric power switch with an anti-flashover nozzle design that suppresses the likelihood of a flashover occurring between switch components other than the switch contactors. In an illustrative embodiment, the anti-flashover nozzle suppresses flashovers from occurring between the nozzle case around the first contactor (e.g., female or socket) casing and the second contactor (e.g., male or pin) during an opening stroke of the contactors. The innovative anti-flashover features include a corona ring positioned at the proximal end of the nozzle casing and a nozzle clamp ring positioned to the distal side of an abutment between the nozzle casing a nozzle receiver. In comparison, the conventional nozzle design includes a nib-shaped nose at the proximal end of the nozzle casing carrying a clamp ring positioned on the proximal side of the abutment. The innovative design significantly reduces the high level of electric field stress created by the conventional nozzle casing, which suppresses the likelihood of a flashover occurring between the nozzle casing and the casing around the opposing contactor during the opening stroke of the contactors.

Figure 1:
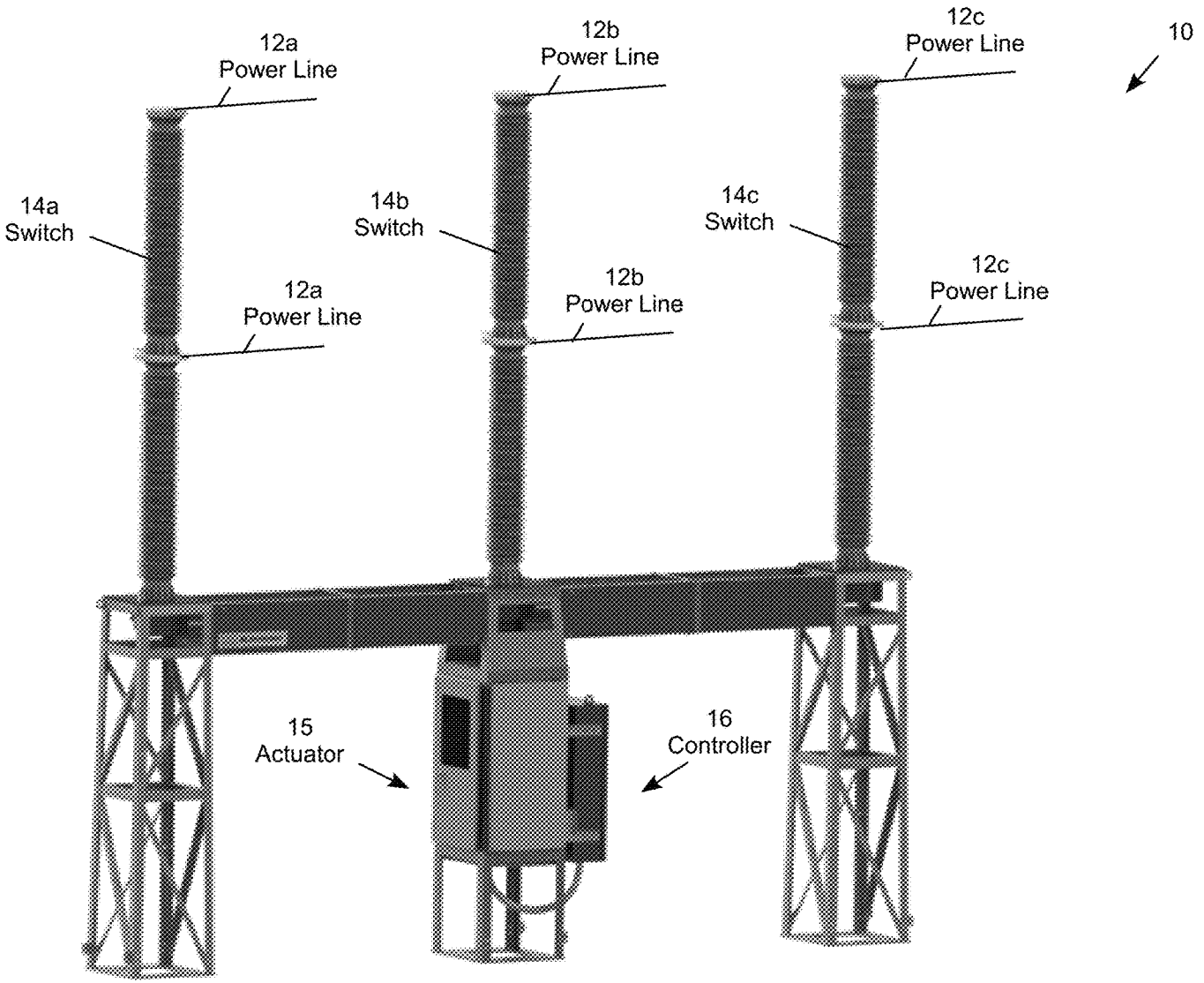
FIG. 1 is a conceptual view of a three-phase high-voltage electric power line switch.

FIG. 1 is a conceptual view of a three-phase high-voltage electric power line switch 10 for three power line phase conductors 12*a-c*. Each phase conductor is directed through a respective switch 14*a-c*. The switches are typically operated by an actuator 15 and a controller 16, which may be operated locally or remotely. Each switch 14*a-c* includes an internal dielectric container containing a penetrating contactor type switch. An example of this type of switch is described in U.S. Pat. No. 8,063,333, which is incorporated herein by reference. An illustrative embodiment of the invention is an improvement to the contactor described in this patent and other similar switches. The improvement, which is referred as an anti-flashover nozzle, is configured to suppress contactor flashover at transmission operating voltages of 69 kV and above.

Figure 2A:
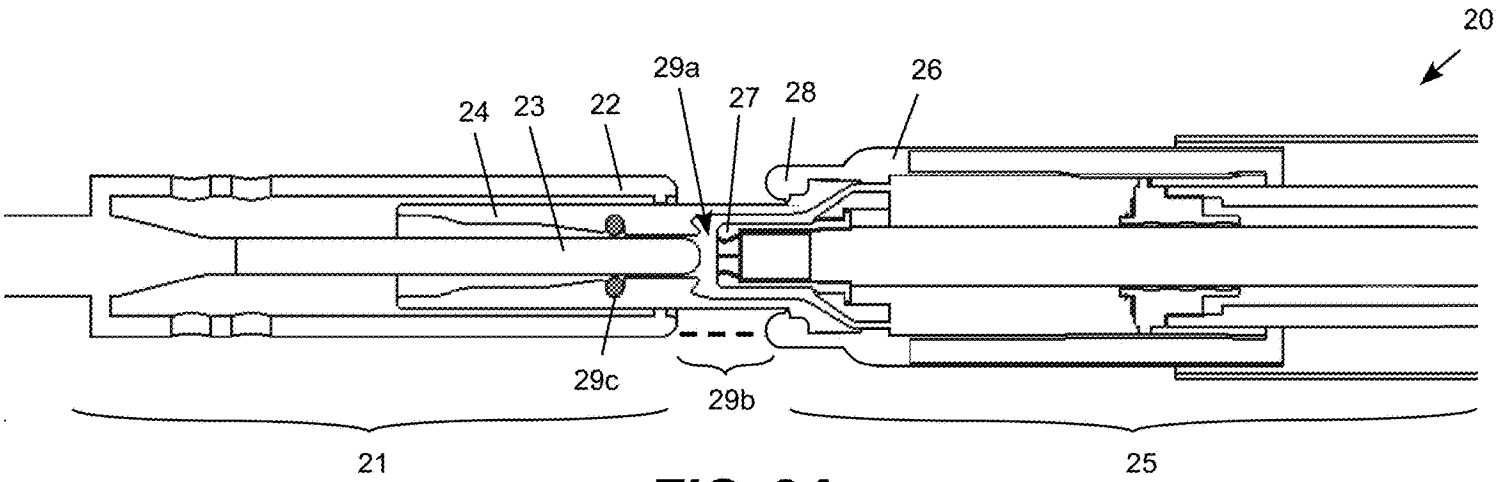
FIG. 2A (Prior Art)
FIG. 2A is a conceptual sectional view of a prior art high-voltage electric power line contactor in an open position.
Figure 2B:
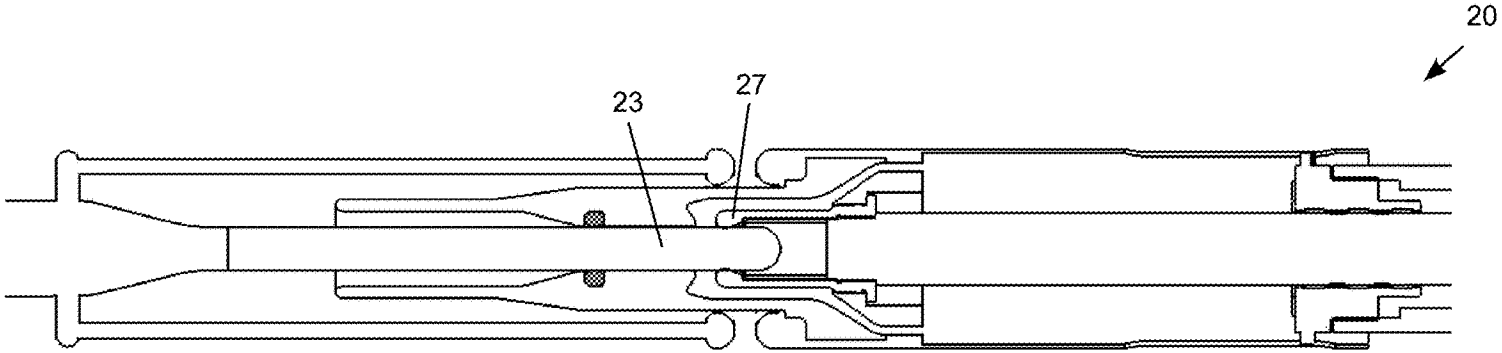
FIG. 2B (Prior Art)
FIG. 2B is a conceptual sectional view of a prior art high-voltage electric power line contactor in a closed position.

FIG. 2A is a conceptual sectional view of a prior art high-voltage electric power line contactor 20 suitable for use in the switches 14*a-c*, and FIG. 2B shows the line contactor 20 in a closed position. The conventional contactor 20 includes a first (male) contactor assembly 21 and a second (female) contactor assembly 25. The male contactor assembly 21 includes a pin casing 22 around a pin (male) contactor 23. With the switch in the position illustrated, a nozzle 24 is located around the pin contactor and partially inside the pin casing 22. The nozzle 24 is connected to and travels with the second (female) contactor assembly 25, which includes a nozzle casing 26 around a socket (female) contactor 27. The nozzle casing 26 terminates in nib-shaped nose 28 that carries a clamp ring that attaches and seals the nozzle casing 26 to the nozzle 24.

In this example, during a switch opening stroke the first (male) contactor assembly 21 is stationary and the second (female) contactor assembly 25 moves laterally from a proximal (closed) position (to the left in FIGS. 2A-2B) with the pin (male) contactor 23 positioned within the socket (female) contactor 27, to a distal (open) position (to the right in FIGS. 2A-2B) with the pin (male) contactor 23 separated from the socket (female) contactor 27. Conversely, during a switch closing stroke the second (female) contactor 27 assembly moves laterally from the distal (open) position (to the right in FIGS. 2A-2B) with the pin (male) contactor 23 apart from the socket (female) contactor 27, to the proximal (closed) position (to the left in FIGS. 2A-2B) to position the pin (male) contactor 23 within the socket (female) contactor 27. As the female contactor assembly 25 travels inside the dielectric container, the dielectric gas is forced through the nozzle 24 and into the arc gap 29*a* between the ends of the male and female contactors 23, 27 to extinguish the arc that forms between the contactors to prevent restrikes across the arc gap 29*a*. It will be appreciated that in an alternative embodiment, a female contactor assembly may be stationary while a male contactor may travel. The nozzle is typically travels with the moving contactor to aid in forcing the dielectric gas int the arc gap.

The contactors 23, 27 and the nozzle 24 are carefully shaped to avoid creating zones of high electric field stress to suppress restrikes from occurring in the arc gap 29*a* between the contactors. In some cases, the contactors 23, 27 suppress restrikes so successfully that a flashover occurs between components other than the contactors. The proximal end of the nose 28 of the nozzle casing 26, in particular, can be a problematic source of flashover initiation due to tight curves and sharply receding spacings inherent in the shapes of the nib and clamp ring structures. For example, a flashover may occur in the gap 29*b* between the proximal end of the nose 28 of the nozzle casing 26 and the distal end of the pin casing 22 even though the casings 22, 26 are physically further apart than the contactors 23, 27. While the casing gap is often the most likely flashover point, other types of flashover can occur, such as flashover from the end of the nozzle casing across the insulator housing, flashover from the end of the nozzle casing to a flashover arrester 29*c* around the pin contactor 23, flashover from the end of the nozzle casing to the pin contactor 23 and so forth.

Figure 3:
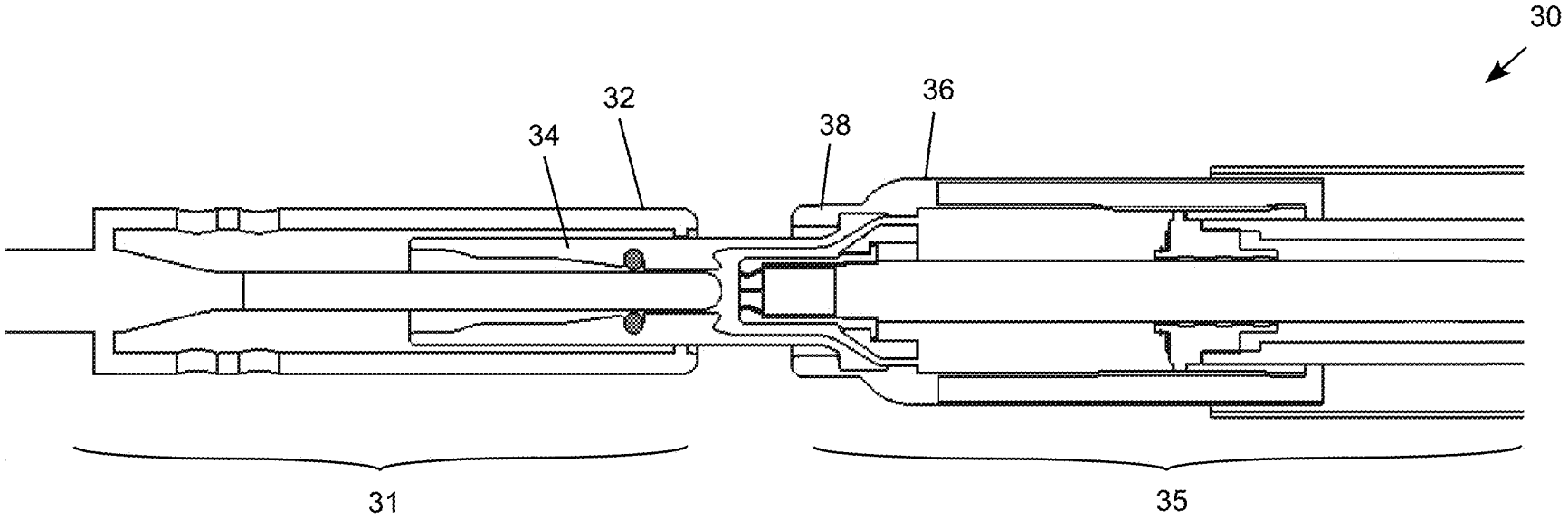
FIG. 3 is a conceptual sectional view of an innovative high-voltage electric power line contactor with an anti-flashover nozzle.

FIGS. 2A-2B show a cross-sectional view of the conventional contactor 20, while FIG. 3 illustrates a cross-sectional view of and improved contactor 30 with an anti-flashover nozzle 34. Referring to FIGS. 2A-2B, the conventional nib-shaped nose 28 of the nozzle casing 26 of the conventional contactor 20 carries a clamp ring near the proximal end of the nozzle casing 26 that physically contacts and forms a seal with the distal portion of the nozzle 24. In the innovative contactor 30, as shown in FIG. 3, the clamp ring near the proximal end of the nozzle casing 36 has been replaced by a corona ring 38, which forms an extended, evenly spaced gap 76 between the corona ring and the distal portion of the nozzle 34. In this design, a clamp ring (see element 71 in FIG. 7) to the distal side of an abutment (see element 72 in FIG. 7), which is to the distal side of the corona ring 38, provides the seal between the nozzle 34 and the nozzle casing 36. The corona ring 38 is shaped to avoid the creation high electrical field stress and thus reduce the likelihood of restrike arcing between the proximal portion of the nozzle casing 36 and the distal portion of the pin casing 32.

Figure 4:
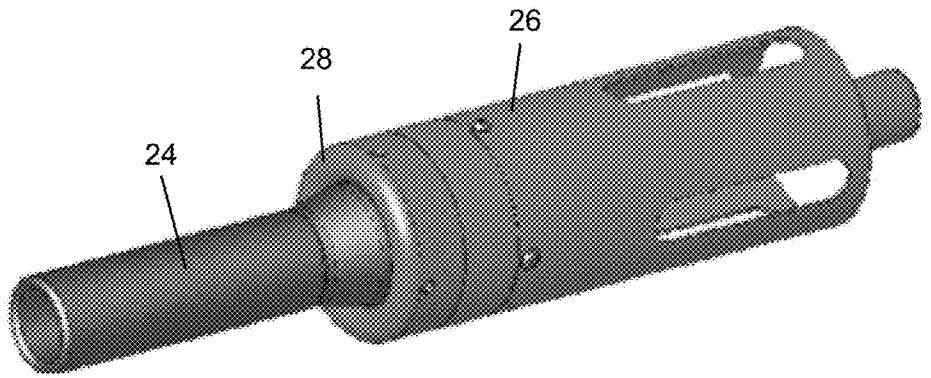
FIG. 4 (Prior Art)
FIG. 4 is a conceptual perspective view of the prior art high-voltage electric power line contactor.
Figure 5:
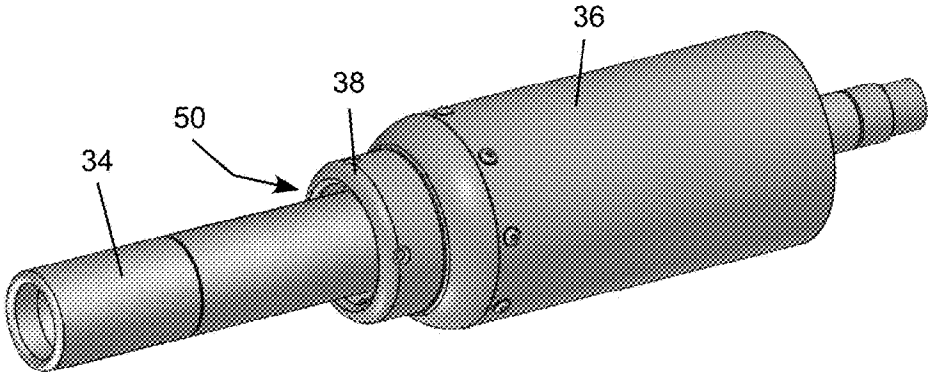
FIG. 5 is a conceptual perspective view of the innovative high-voltage electric power line contactor with the anti-flashover nozzle.

FIG. 4 show a perspective view of the exterior of the conventional nozzle design, while FIG. 5 shows a perspective view of the exterior of the improved anti-flashover nozzle. FIG. 4 shows the exposed portion of the nozzle 24 and the proximal end 28 of the nozzle casing 26 of the conventional design, while FIG. 5 shows the exposed portion of the nozzle 34 and corona ring 38 at the proximal end of the nozzle casing 36 of the improved design. FIG. 5 also shows the smooth, non-perforated proximal face 50 at the proximal end of the extended, evenly spaced gap between the corona ring 38 and the distal portion of the nozzle 34.

Figure 6:
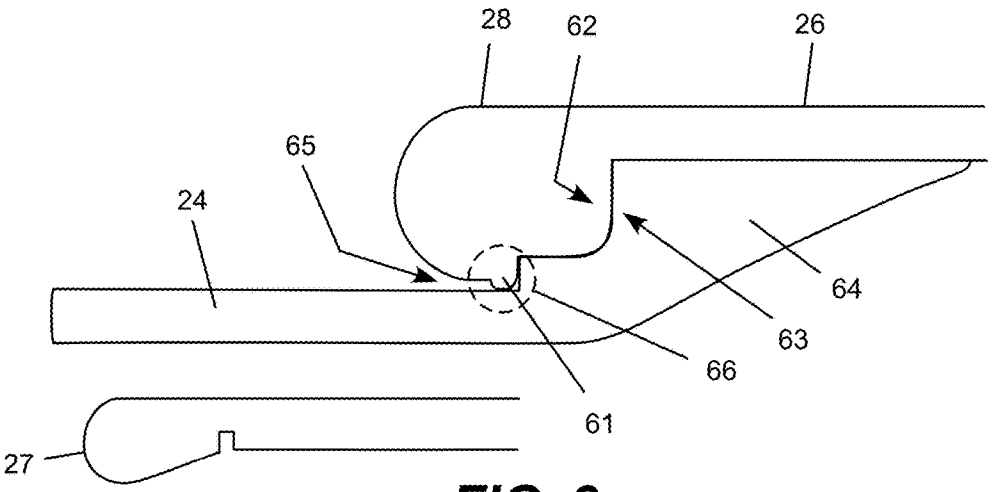
FIG. 6 (Prior Art)
FIG. 6 is a conceptual profile view of the prior art high-voltage electric power line contactor.
Figure 7:
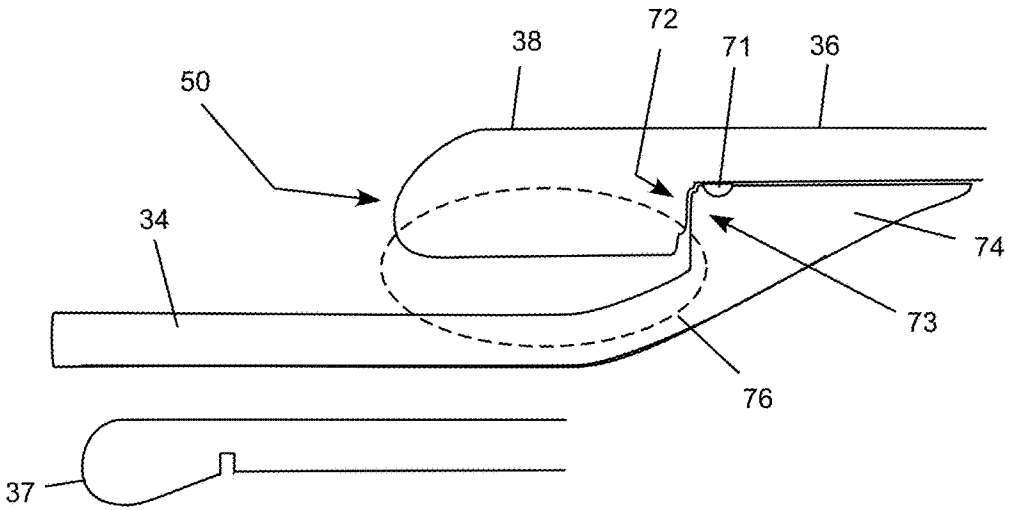
FIG. 7 is a conceptual profile view of the innovative high-voltage electric power line contactor with the anti-flashover nozzle.
Figure 8:
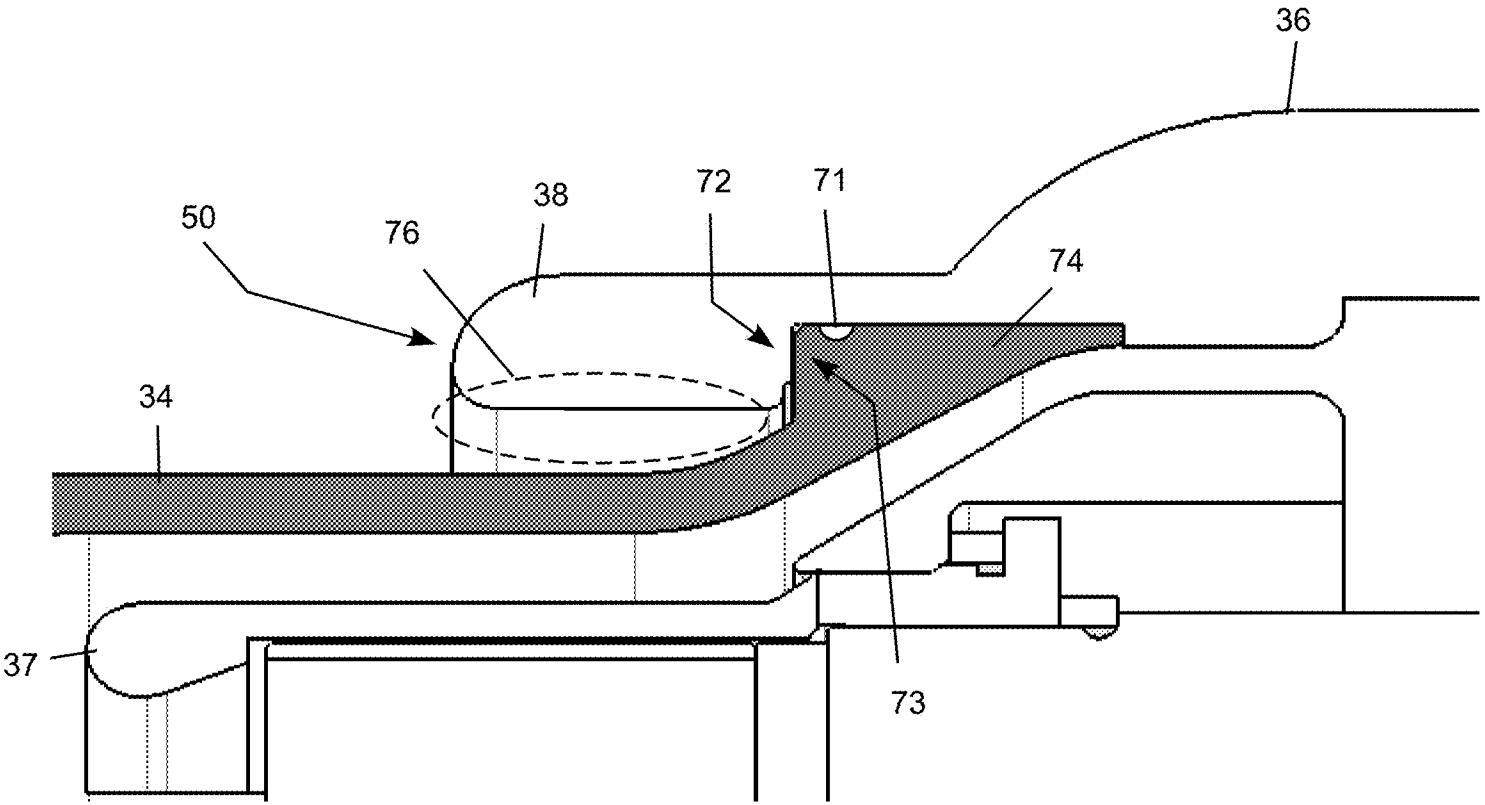
FIG. 8 is a conceptual perspective sectional view of the innovative high-voltage electric power line contactor with the anti-flashover nozzle.

FIG. 6 shows a detail view of the interface between the nozzle 24 and the nozzle casing 26 in the conventional contactor 20, while FIG. 7 shows a detail view of the interface between the nozzle 34 and the nozzle casing 36 in the improved contactor 30. FIG. 8 shows a perspective similar to FIG. 7. Referring to FIG. 6, the clamp ring 61 forms a seal between the nozzle 24 and the nozzle casing 26 in the conventional contactor 20. The clamp ring 61 is position to the proximal side of an abutment 62 formed between a nozzle receive 63 at the distal end of the nozzle 24 and the nib-shaped nose 28 of the nozzle casing 26. The interface region 66 between the nose 28 of the nozzle casing 26 and the nozzle 24, including the clamp ring 61, have surfaces with tight curvature and sharply receding spacings 65. These features result in areas of high electric field stress that increase the likelihood of restrike arcing at these surfaces.

FIGS. 7 and 8 illustrate techniques used to reduce the electric field stress, and thus suppress flashover, in these areas in the improved contactor 30. The improved design includes an elongated corona ring 38 on the proximal end of the nozzle casing 36 and a clamp ring 71 that is located to the distal side of an abutment 72 that is located between a nozzle receiver 73 on the distal end of the nozzle 34 and the corona ring 38. As a result, the nib-shaped nose 28 of the nozzle casing 26 in the conventional contactor 20 has been replaced by the corona ring 38 with a smooth, non-perforated proximal face 50 and an extended, evenly spaced gap 76 in the improved contactor 30. Specifically, the length of the evenly spaced portion of the gap 76 in the improved contactor 30 is at least twice the distance across the gap, which is quite different from the region around the clamp ring 61 in the conventional contactor 20. The distance across the gap 76 is also greater than the thickness of the wall of the nozzle 34 along a proximal portion of the gap. In addition, the clamp ring 71 is located to the distal side of the abutment 72 in the improved contactor 30, while the clamp ring 61 is located to the proximal side of the abutment 72 in the improved contactor 30. This is another important difference, which moves the clamp ring 71 away from the proximal end of the nozzle casing where it can cause high electric field stress, to a position distal of the abutment 72 where it is shielded by the corona ring 38 and therefore cannot cause high electric field stress.

Figure 9A:
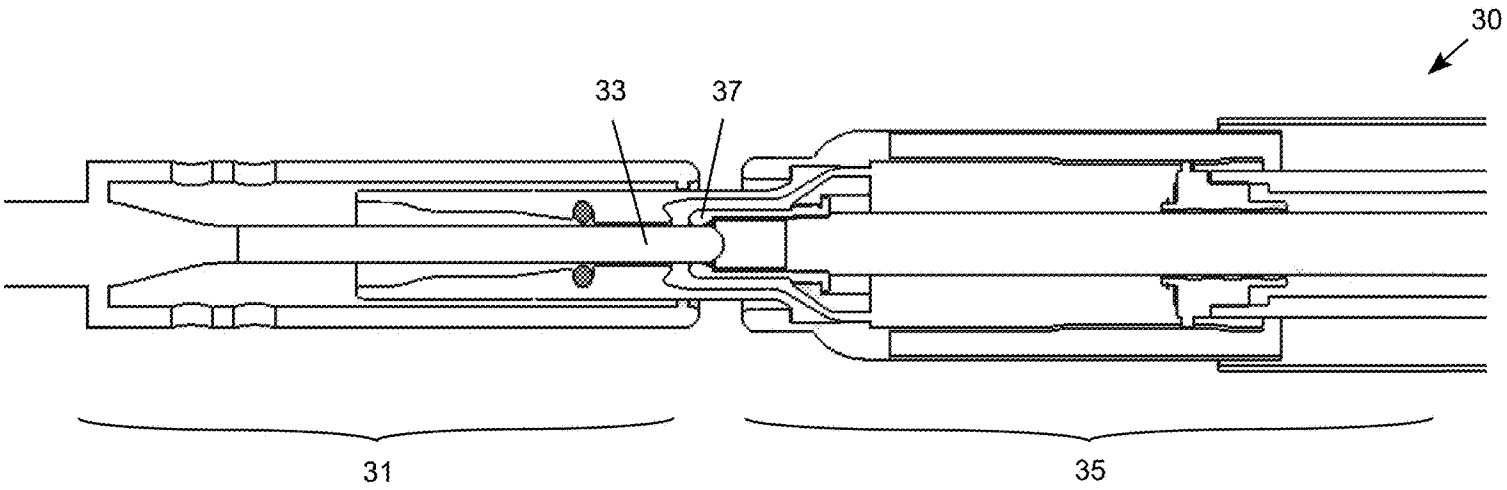
FIG. 9A is a conceptual sectional view of the innovative high-voltage electric power line contactor in a closed position.
Figure 9B:
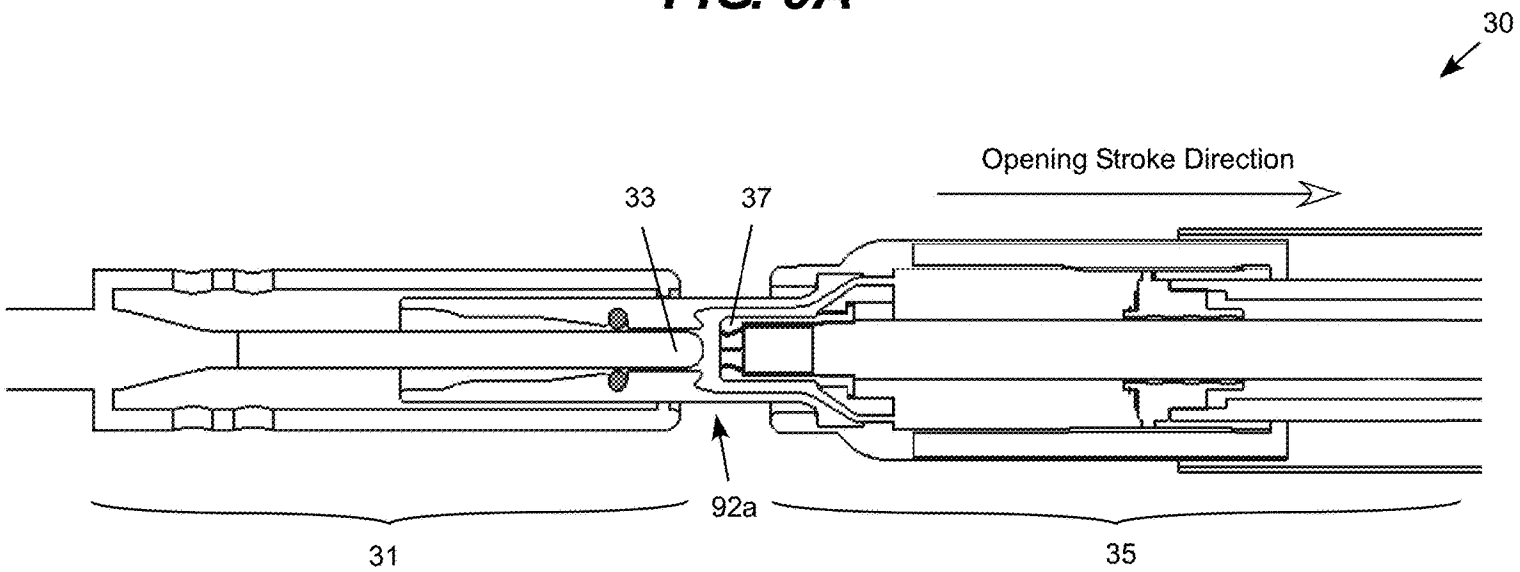
FIG. 9B is a conceptual sectional view of the innovative high-voltage electric power line contactor at a first midpoint during an opening stroke.
Figure 9C:
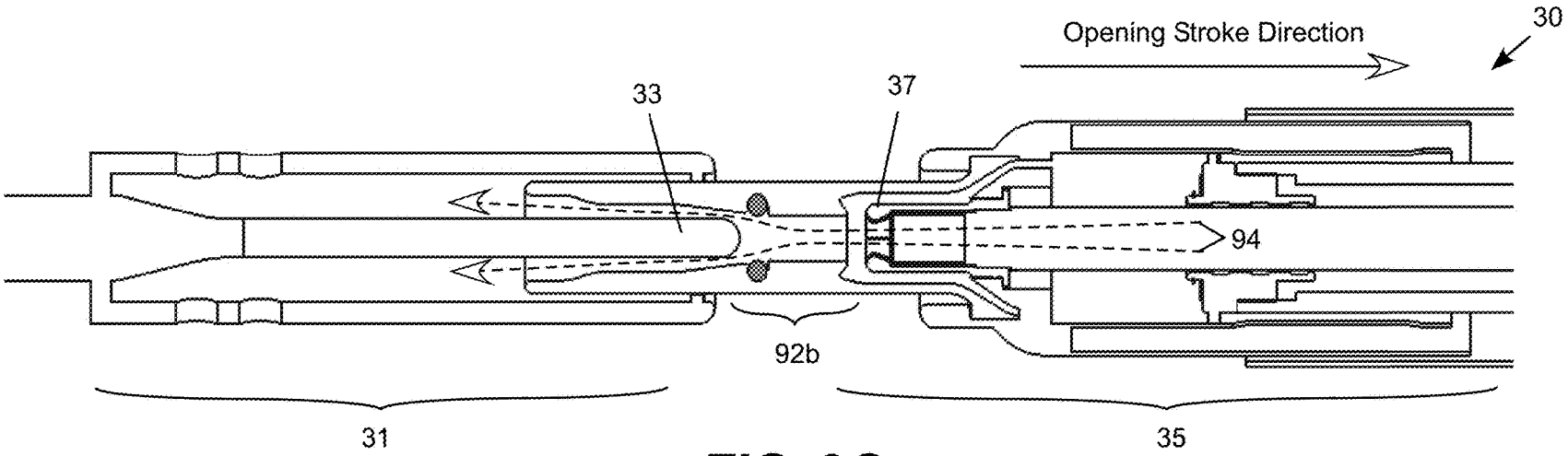
FIG. 9C is a conceptual sectional view of the innovative high-voltage electric power line contactor at a second midpoint during an opening stroke.
Figure 9D:
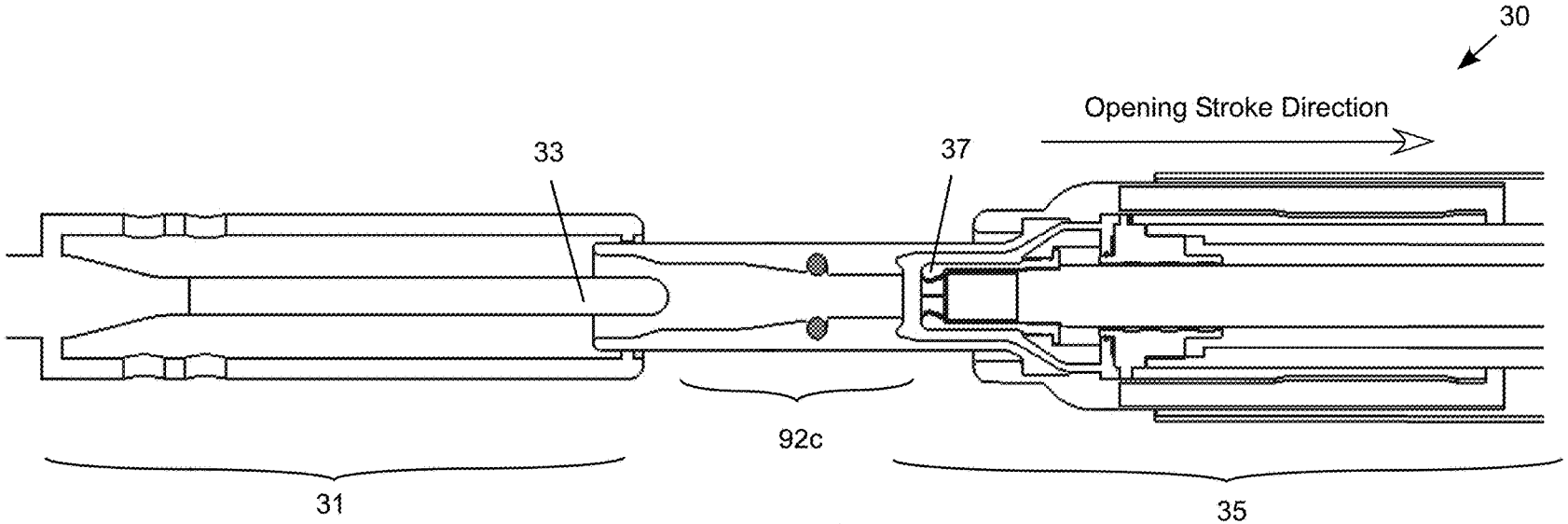
FIG. 9D is a conceptual sectional view of the innovative high-voltage electric power line contactor an open position.

FIGS. 9A-9D illustrate an opening stroke of the improved high-voltage electric power line contactor 30. FIG. 9A shows the contactor 30 in a closed position with the male (pin) contactor 33 positioned within the female (socket) contactor 37 prior to an opening stroke. During the opening stroke, the female contactor assembly 35 moves in a distal direction (right in FIG. 9A) away from the male contactor assembly 31. FIG. 9B shows the switch 30 at a first midpoint during the opening stroke, where the male (pin) contactor 33 has separated slightly from the female (socket) contactor 37 forming a small arc gap 92*a* between the contactors. FIG. 9C shows the contactor 30 at a second midpoint during the opening stroke, where the male (pin) contactor 33 has separated further from the female (socket) contactor 37 forming a larger arc gap 92*b* between the contactors and allowing the dielectric gas 94 (broken-line arrows) to flow into the arc gap. FIG. 9D shows the contactor 30 at the fully open point where the male (pin) contactor 33 has fully separated from the female (socket) contactor 37 with the gap 92*c* at its maximum.

It should be understood that the foregoing relates only to the exemplary embodiments of the present invention, and that numerous changes may be made therein without departing from the spirit and scope of the invention as defined by the following claims.

The invention claimed is:

1. A high-voltage electric power switch comprising a dielectric gas canister housing a contactor, comprising:

a pin contact and a socket contact movable during an opening stroke from a closed position in which the pin contact is electrically in contact with the socket contact to an open position in which the pin contact is electrically separated from the socket contact, and movable during a closing stroke from the open position to the closed position, creating an arc gap between the pin contact and the socket contact during the opening and closing strokes;

a nozzle configured to force a dielectric gas into the gap during the opening and closing strokes comprising a nozzle receiver on a distal end of the nozzle;

a nozzle casing forming an abutment between the nozzle receiver and the nozzle casing;

a corona ring comprising a smooth, non-perforated proximal face positioned at a proximal end of the nozzle casing to suppress flashover at the proximal end of the nozzle casing.

2. The high-voltage electric power switch of claim 1, further comprising an elongated gap between the corona ring and the nozzle.

3. The high-voltage electric power switch of claim 1, further comprising an elongated gap between the corona ring and the nozzle wherein a length of the gap in a direction of the opening stroke is at least twice a width of the gap transverse to the direction of the opening stroke.

4. The high-voltage electric power switch of claim 1, further comprising a clamp ring creating a seal between the nozzle and the nozzle casing located to a distal side of the abutment.

5. The high-voltage electric power switch of claim 1, further configured to suppress flashover at an operating voltage of at least 69 kV.

6. The high-voltage electric power switch of claim 1, wherein a distance across the gap is greater than a thickness of a wall of the nozzle along a proximal portion of the gap to suppress flashover at the proximal end of the nozzle casing.

7. A high-voltage electric power switch comprising a dielectric gas canister housing a contactor, comprising:

a pin contact and a socket contact movable during an opening stroke from a closed position in which the pin contact is electrically in contact with the socket contact to an open position in which the pin contact is electrically separated from the socket contact, and movable during a closing stroke from the open position to the closed position, creating an arc gap between the pin contact and the socket contact during the opening and closing strokes;

a nozzle configured to force a dielectric gas into the gap during the opening and closing strokes comprising a nozzle receiver on a distal portion of the nozzle;

a nozzle casing forming an abutment between the nozzle receiver and the nozzle casing;

a corona ring comprising a smooth, non-perforated proximal face positioned at a proximal end of the nozzle casing to suppress flashover at the proximal end of the nozzle casing;

the corona ring forming an elongated gap between the corona ring and the nozzle;

a clamp ring creating a seal between the nozzle and the nozzle casing located to a distal side of the abutment; and wherein, a distance across the gap is greater than a thickness of a wall of the nozzle along a proximal portion of the gap to suppress flashover at the proximal end of the nozzle casing.

8. The high-voltage electric power switch of claim 7, wherein a length of the elongated gap in a direction of the opening stroke is at least twice a width of the gap transverse to the direction of the opening stroke.

9. The high-voltage electric power switch of claim 7, further configured to suppress contactor flashover at an operating voltage of at least 69 kV.

10. A method for suppressing contactor flashover at a high-voltage electric power switch comprising a dielectric gas canister housing a contactor, comprising:

providing a pin contact and a socket contact movable during an opening stroke from a closed position in which the pin contact is electrically in contact with the socket contact to an open position in which the pin contact is electrically separated from the socket contact, and movable during a closing stroke from the open position to the closed position, creating an arc gap between the pin contact and the socket contact during the opening and closing strokes;

providing a nozzle configured to force a dielectric gas into the gap during the opening and closing strokes comprising a nozzle receiver on a distal portion of the nozzle;

providing a nozzle casing comprising a corona ring comprising a smooth, non-perforated proximal face at a proximal end of the nozzle casing to suppress flashover at the proximal end of the nozzle casing.

11. The method of claim 10, further comprising providing an elongated gap between the corona ring and the nozzle.

12. The method of claim 10, further comprising providing an elongated gap between the corona ring and the nozzle wherein a length of the gap in a direction of the opening stroke is at least twice a width of the gap transverse to the direction of the opening stroke.

13. The method of claim 10, further comprising providing a clamp ring located to the distal side of the abutment.

14. The method of claim 10, further comprising configuring the contactor to suppress flashover at an operating voltage of at least 69 kV.

15. The method of claim 10, wherein, further comprising providing a distance across the gap that is greater than a thickness of a wall of the nozzle along a proximal portion of the gap suppressing flashover at the proximal end of the nozzle casing.

* * * * *